US007302387B2

(12) United States Patent
Li et al.

(10) Patent No.: US 7,302,387 B2
(45) Date of Patent: Nov. 27, 2007

(54) MODIFICATION OF FIXED CODEBOOK SEARCH IN G.729 ANNEX E AUDIO CODING

(75) Inventors: Dunling Li, Rockville, MD (US); Gokhan Sisli, Bethesda, MD (US)

(73) Assignee: Texas Instruments Incorporated, Dallas, TX (US)

( * ) Notice: Subject to any disclaimer, the term of this patent is extended or adjusted under 35 U.S.C. 154(b) by 967 days.

(21) Appl. No.: 10/160,122

(22) Filed: Jun. 4, 2002

(65) Prior Publication Data

US 2003/0225576 A1 Dec. 4, 2003

(51) Int. Cl.
*G10L 10/12* (2006.01)

(52) U.S. Cl. ..... 704/223

(58) Field of Classification Search ..... None
See application file for complete search history.

(56) References Cited

U.S. PATENT DOCUMENTS 5,734,789 A * 3/1998 Swaminathan et al. ..... 704/206
6,782,360 B1 * 8/2004 Gao et al. ..... 704/222
2002/0007269 A1 * 1/2002 Gao ..... 704/212
2003/0009325 A1 * 1/2003 Kirchherr et al. ..... 704/211

* cited by examiner

*Primary Examiner*—Abul K. Azad
(74) *Attorney, Agent, or Firm*—Wade J. Brady, III; Frederick J. Telecky, Jr.

(57) ABSTRACT

ITU Recommendation G.729 Annex E teaches in the implementation of a fixed codebook search to determine the selected sample combination providing the minimal difference between the original input speech and the reconstructed speech after implementation of the codec. A large number of sample sets are processed and the difference between the original input signal and the reconstructed signal for each set is determined and stored in a register. Under certain conditions, the register can overflow resulting in invalid difference values. When such a condition occurs, the fixed codebook search cannot determine the sample combination providing the minimal mean square error between the weighted input speech and the weighted reconstructed speech. An initialization vector for the codvec vector is used to provide valid data which conforms to the G.729 Annex E specifications and minimizes changes to the G.729 source code while providing robust quality signal processing in the event of register overflow condition.

12 Claims, 5 Drawing Sheets

| | EXTENSION AT 11.8 kbit/s | |
|---|---|---|
| LP mode indication bit | **1 + 1 (parity)** | |
| | FORWARD | BACKWARD |
| LP filter | 18 | 0 |
| LTP Delay (1st/2nd sub-fr.) | 8 + 1 (parity)/5 | 8 + 1 (parity)/5 |
| EXC Codes (1st/2nd sub-fr.)<br>Gains (LTP + EXC) (1st/2nd sub-fr.) | **35/35**<br>7/7 | **44/44**<br>7/7 |
| Total | 118 | 118 |

FIGURE 4

| Track | Pulses | Signs | Positions |
|---|---|---|---|
| 1 | *p0, p1* | $s_0, s_1: \pm 1$ | 0, 5, 10, 15, 20, 25, 30, 35 |
| 2 | *p2, p3* | $s_2, s_3: \pm 1$ | 1, 6, 11, 16, 21, 26, 31, 36 |
| 3 | *p4, p5* | $s_4, s_5: \pm 1$ | 2, 7, 12, 17, 22, 27, 32, 37 |
| 4 | *p6, p7* | $s_6, s_7: \pm 1$ | 3, 8, 13, 18, 23, 28, 33, 38 |
| 5 | *p8, p9* | $s_8, s_9: \pm 1$ | 4, 9, 14, 19, 24, 29, 34, 39 |

FIGURE 5

| Symbol | Description | Bits |
|---|---|---|
| *M0* | Switch LP mode | 1 |
| *M1* | Parity bit for LP mode | 1 |
| *L0* | Switched MA predictor of LSP quantizer | 1 |
| *L1* | First stage vector of quantizer | 7 |
| *L2* | Second stage lower vector of LSP quantizer | 5 |
| *L3* | Second stage higher vector of LSP quantizer | 5 |
| *P1* | Pitch delay first subframe | 8 |
| *P0* | Parity bit for pitch delay | 1 |
| *C0_1* | Track 0 fixed codebook first subframe | 7 |
| *C1_1* | Track 1 fixed codebook first subframe | 7 |
| *C2_1* | Track 2 fixed codebook first subframe | 7 |
| *C3_1* | Track 3 fixed codebook first subframe | 7 |
| *C4_1* | Track 4 fixed codebook first subframe | 7 |
| *GA1* | Gain codebook (stage 1) $1^{st}$ subframe | 3 |
| *GB1* | Gain codebook (stage 2) $1^{st}$ subframe | 4 |
| *P2* | Pitch delay second subframe | 5 |
| *C0_2* | Track 0 fixed codebook second subframe | 7 |
| *C1_2* | Track 1 fixed codebook second subframe | 7 |
| *C2_2* | Track 2 fixed codebook second subframe | 7 |
| *C3_2* | Track 3 fixed codebook second subframe | 7 |
| *C4_2* | Track 4 fixed codebook second subframe | 7 |
| *GA2* | Gain codebook (stage 1) $2^{nd}$ subframe | 3 |
| *GB2* | Gain codebook (stage 2) $2^{nd}$ subframe | 4 |

FIGURE 6

| Symbol | Description | Bits |
|---|---|---|
| *M0* | Switch LP mode | 1 |
| *M1* | Parity bit for LP mode | 1 |
| *P1* | Pitch delay first subframe | 8 |
| *P0* | Parity bit for pitch delay | 1 |
| *C0_1* | Fixed codebook track index + pulses 0, 5 and 10 first subframe | 13 |
| *C1_1* | Fixed codebook pulses 1, 6 and 11 first subframe | 10 |
| *C2_1* | Fixed codebook pulses 2 and 7 first subframe | 7 |
| *C3_1* | Fixed codebook pulses 3 and 8 first subframe | 7 |
| *C4_1* | Fixed codebook pulses 4 and 9 first subframe | 7 |
| *GA1* | Gain codebook (stage 1) 1st subframe | 3 |
| *GB1* | Gain codebook (stage 2) 1st subframe | 4 |
| *P2* | Pitch delay second subframe | 5 |
| *C0_2* | Fixed codebook track index + pulses 0, 5 and 10 second subframe | 13 |
| *C1_2* | Fixed codebook pulses 1, 6 and 11 second subframe | 10 |
| *C2_2* | Fixed codebook pulses 2 and 7 second subframe | 7 |
| *C3_2* | Fixed codebook pulses 3 and 8 second subframe | 7 |
| *C4_2* | Fixed codebook pulses 4 and 9 second subframe | 7 |
| *GA2* | Gain codebook (stage 1) 2nd subframe | 3 |
| *GB2* | Gain codebook (stage 2) 2nd subframe | 4 |

FIGURE 7

MODIFICATION OF FIXED CODEBOOK SEARCH IN G.729 ANNEX E AUDIO CODING

CROSS-REFERENCE TO RELATED APPLICATIONS

NA

FIELD OF THE INVENTION

The invention relates to improving coding of analogue signals for transmission by G.729 transmission. The present invention relates to the modification of the fixed codebook in coding of audio signals including speech and music using conjugate-structure algebraic-code-excited linear-prediction (CS-ACELP).

BACKGROUND OF THE INVENTION

The International Telecommunication Union (ITU) Recommendation G.729 Annex E describes coding of analogue signals by methods other than PCM. This higher bit-rate extension of G.729 is designed to accommodate a wide range of input signals such as speech with background noise and music. The G.729 Annex E introduces a backward LP analysis and introduces two new algebraic expectation codebooks to extend the bit rate. One codebook is used in forward mode, the other codebook is used in backward mode. Two LP analyses are performed at the same frame rate, one backward on the synthesis signal and one forward on the input signal. An adaptive decision procedure chooses the best filter and performs a switch between filters if needed. The backward/forward decision criterion enables the operation of a real discrimination between speech (mainly coded in forward mode) and music (mainly coded in backward mode.)

The overall general operation of the G.729 codec is illustrated in FIG. 1 which is a simplified functional block diagram of the encoding of an audio signal and FIG. 2 which is a simplified functional block diagram of the decoding of an audio signal and FIG. 3 which is a simplified block diagram of the fixed codebook search. First, as illustrated by block of 12, in FIG. 1, an audio signal is received in analogue form by a device such as a telephone. The analogue signal is converted to a digital signal and pre-processed 14. The digital signal S will have a sample rate, for example 80 samples per 10 ms. The signal S is then encoded as defined by the codec. The signal is passed through an L/P filter 16 which processes the signal both backwards and forwards as detailed below. The L/P filter 16 generates that portion of the codec corresponding to the short-term characteristics of the original audio signal. The signal is processed to generate portions of the codec corresponding to the characteristics of the original audio signal.

In accordance with the specifications of the G.729 Annex E. codec, the residual portion of the signal is used to generate a series of pulses from which the residual signal is re-created by the decoder. The residual filter relies upon a codebook, FIG. 5, to select the samples to be used for encoding and decoding. In the example above, the signal can be divided into 5 ms sample size. Each five millisecond portion of the signal consists of forty samples. Based on the residual signal, the fixed codebook search 20 selects a subset of these samples and generates a series of pulses of having either a positive or negative value corresponding to the selected samples. The decoder relies on these samples to recreate the residual signal. The fixed codebook search algorithm evaluates a number of different groups of selected samples to determine the sample selection which will best recreate the original signal when regenerated by the decoder. The fixed codebook algorithm implements a search procedure to find the minimized mean squared error between the weighted input speech and the reconstructed speech.

The samples can be designated as samples one through forty, as illustrated in FIG. 2. The fixed codebook search algorithm selects the samples to be used based upon the codebook of the G.729 annex E. The fixed codebook search algorithm selects a set of samples, for example samples 0, 5, 10, 15, 20, 25, 30, 35 from track one of the codebook, FIG. 5. The search algorithm process the input speech based upon these selected samples and creates the code vectors which would be transmitted to the decoder as part of the packetized transmission, FIG. 1.

As illustrated in FIG. 3, the code vectors are also processed within the encoder to reconstruct the signal and the reconstructed signal is compared to the input speech. The difference between the reconstructed speech and the input speech is measured and quantified and stored in a register 22. This process is repeated for other sample sets from tracks 1 through 5. Once all of the samples sets have been processed and the deviation from the original speech quantified, the register is checked to determine which set of samples produced the minimum difference from the original input speech 23. The set of samples with the minimum difference are encoded into the bit stream.

The structure of the codec and code vectors is illustrated in FIG. 4. Since the LP coefficients are not transmitted in backward mode, the spare bit rate is used to increase the size of the algebraic excitation codebooks. One information bit is needed to indicate the LP mode and is protected by a parity bit. In the extension, all the additional bit rate from 8 kbit/s to 11.8 kbit/s, except two bits (LP indication mode+parity bit), is used to increase the size of the algebraic codebooks. The bit allocation of the coder parameters is shown in the table of FIG. 4.

The backward/forward procedure of G.729 Annex E has been also designed to reduce the number of switches and to perform, when necessary, smooth switching between filters with no artefacts. The LP mode and the related information is used to better adapt postfiltering and perceptual weighting to either music or speech. This is also used for error concealment.

In order to obtain this high quality with music while maintaining robust resistence to transmission errors and avoiding degradation of less stationary signals and especially speech, Annex E of G.729 introduced a new technique called mixed backward/forward LP structure. A criterion enabled to choose the most suitable LP analysis given the stationarity of the input signal and the backward and forward filters prediction gains.

For music signals, generally very stationary, the LP backward mode is mainly used: the LP analysis is performed on the synthesis signal with no transmission of the coefficients with two benefits: The LP order is increased up to 30 coefficients which is far more suited for the complex spectrum of music signals (the 10 coefficients LP filter of LP forward codecs like G.729 is not sufficient for music) and the bit rate is better allocated: no bit rate is wasted on successive very similar LP filters. All the spare bit rates are used to extend the size of the excitation codebook. An algebraic codebook with 44 bits is used for the fixed codebook excitation. The weak points of pure backward LP analysis mainly concern the non-stationary signals with sharp spectrum transitions and the sensitivity to transmission errors. With the mixed LP backward/forward structure, if a spectrum transition occurs, the forward mode is selected and the 10 LP coefficients are coded and transmitted. Even if backward mode is dominant, the transmission of forward LP filters clearly improves the robustness when compared with a pure backward structure.

In forward mode, the encoder is almost identical to G.729 with more bits allocated to the excitation codebooks. An algebraic codebook with thirty five bits is used for the fixed codebook excitation.

When decoding, FIG. 1, the fixed codebook 32 and adaptive codebook 34 decode is implemented and the signal is processed by the short term filter 36. Decoding obtains the coder parameters corresponding to a 10 ms speech frame. The first parameter decoded is the LP mode information and its parity bit. According to this information, the frame is classified either as forward, backward or erased. In forward mode, the parameters are the LSP coefficients, the two fractional pitch delays, the two forward fixed-codebook vectors, and the two sets of adaptive-and fixed-codebook gains. In backward mode, the parameters are the two fractional pitch delays, the two backward fixed-codebook vectors, and the two sets of adaptive-and fixed-codebook gains. First the LP backward analysis is performed. Then, if the frame is in forward mode, the LSP coefficients are interpolated and converted to LP filter coefficients for each sub-frame. Except for the construction of fixed-codebook excitation, the decoding procedure is very similar to the G.729 decoding procedure.

Then, for each 5 ms sub-frame the following steps are done: first, the excitation is constructed by adding the adaptive-and fixed-codebook vectors scaled by their respective gains. Next, the speech is reconstructed by filtering the excitation through the LP synthesis filter (either forward or backward). Then, the reconstructed speech signal is passed through a post-processing stage 37, which can include an adaptive postfilter based on the long-term and short-term synthesis filters, followed by a high-pass filter and scaling operation. Compared with G.729, the weighting factors of the postfilter have been made adaptive. The speech coding algorithms are bit-exact, fixed-point mathematical operations.

The encoder has several different functions, including:

Pre-processing.

Linear prediction analysis and quantization.

Windowing and autocorrelation computation.

Levinson Durbin algorithm implementation.

LP to LSP conversion.

Quantization of LSP coefficients.

Interpolation of LP coefficients.

LSP to LP conversion.

Backward/forward decision and switching.

Determination of the global stationarity indicator and high stationarity indicator.

Perceptual weighting.

Open-loop pitch analysis.

Computation of the impulse response.

Computation of the target signals.

The encoder also implements the adaptive-codebook search wherein the generation of the adaptive-codebook vector, the codeword computation for the delay index P1 and P2 and the computation of the adaptive-codebook gain are identical to the procedure in G.729. The parity bit P0 computed on the seven (instead of six in G.279) most significant bits of the delay index P1 of the first sub-frame.

Annex E introduces a fixed codebook structure and search. In the forward LP mode, an algebraic codebook with 35 bits is used as the fixed codebook. In this codebook, each excitation vector contains 10 non-zero pulses. The pulse amplitudes are either −1 or +1. The 40 positions in each sub-frame are divided into 5 tracks where each track contains two pulses. In the design, the two pulses for each track may overlap resulting in a single pulse with amplitude +2 or −2. The allowed positions for pulses are illustrated in FIG. 5.

Similar to G.729, the selected codebook vector is filtered through the pre-filter to enhanced the harmonic components. The codebook is searched to determine the optimal pulse positions within the sample.

The fixed codebook is searched by minimizing the mean-squared error between the weighted input speech and the weighted reconstructed speech. If $c_k(n)$ is the algebraic codevector at index k, h(n) is the impulse response of the weighted synthesis filter, and d(n) is the correlation between the target vector and h(n), then the algebraic codebook is searched by maximizing the criterion:

$$T_k = \frac{(C_k)^2}{E_k}$$

where C is the correlation between $c_k(n)$ and d(n) and E is the energy of the filtered codevector ($c_k(n)*h(n)$). Since the algebraic codevector contains few non-zero pulses, the correlation can be written as:

$$C = \sum_{i=0}^{N_p-1} s_i d(m_i)$$

where $m_l$ is the position of the ith pulse, $s_l$ is its amplitude, and $N_p$ is the number of pulses ($N_p$=10), and the energy in the denominator is given by:

$$E = \sum_{i=0}^{N_p-1} \phi(m_i, m_i) + 2\sum_{i=0}^{N_p-2}\sum_{j=i+1}^{N_p-1} s_i s_j \phi(m_i, m_i)$$

where $\phi(i,j)$ contains the correlations between h(n−i) and h(n−j). The signal d(n) and the correlations $\phi(i,j)$ are computed before the codebook search.

Similar to G.729, in order to speed up the search procedure, the pulse amplitudes are pre-set outside the closed-loop search using the so-called signal-selected pulse amplitude approach. In this approach, the most likely amplitude of a pulse occurring at a certain position is estimated using a certain side information signal. In G.729, the signal d(n) is used for pre-selecting the pulse amplitudes. In this bit rate extension, a signal b(n), which is a weighted sum of the normalized d(n) vector and the normalized long-term prediction residual, is used.

The signal b(n) is given by:

$$b(n)=d(n)/\sigma_d+e(n)/\sigma_e$$

where e(n) is the long-term prediction residual and $\sigma_d$ and $\sigma_e$ are the r.m.s. values of d(n) and e(n), respectively. The sign of a pulse at a certain position is set a priori equal to the sign of b(n) at that position. The sign information is incorporated into the signals d(n) and $\phi(i,j)$ before starting the search for the best pulse positions, similar to G.729.

The optimal pulse positions are determined using a non-exhaustive analysis-by-synthesis search procedure. The used procedure is a special case of a general depth-first tree search method which is efficient for searching huge codebooks with a reasonable complexity. In this approach, the $N_p$ excitation pulses are partitioned into M subsets of $N_m$ pulses. The search begins with subset 1 and proceeds with subsequent subsets according to a tree structure whereby subset m is searched at the mth level of the tree. The search is repeated by changing the order in which the pulses are assigned to the position tracks. In this particular codebook structure, the pulses are partitioned into 5 subsets of 2 pulses (the tree has 5 levels).

The pulse positions are determined as follows:

For each of the five tracks, the pulse positions with maximum absolute values of d(n) are found. From these, the two successive tracks, $T_{k_0}$ and $T_{(k_0+1)\ mod\ 5}$ with the largest combined maxima are determined. This index $k_0$ is used for the initial assignment of pulses to tracks. Then the two successive tracks, $T_{k_1}$ and $T_{(k_1+1)\ mod\ 5}$ with the second largest combined maxima and the two successive tracks, $T_{k_2}$ and $T_{(k_2+1)\ mod\ 5}$ with the third largest combined maxima are also determined.

In the first iteration, the pulses are assigned to the tracks as follows: the pulses $i_n$, n=0, . . . , 9, are assigned to tracks $T_{(k_0+n)\ mod\ 5}$, n=0, . . . , 9, respectively.

The pulses are searched in subsets of two pulses. The process begins by setting pulse $i_0$ to the maximum of track $T_{k_0}$ and pulse $i_1$ to the maximum of track $T_{(k_0+1)\ mod\ 5}$. We then proceed by searching the pulse pair ($i_2$, $i_3$) by testing all the 8×8 possible position combinations in tracks $T_{(k_0+2)\ mod\ 5}$ and $T_{(k_0+3)\ mod\ 5}$ (given pulses $i_0$ and $i_1$ are known). The same procedure is repeated for the rest of the pulse pairs($i_4$, $i_5$), ($i_6$, $i_7$), and ($i_8$, $i_9$), by testing the 8×8 possible position combinations in their respective tracks. At each level of the tree, the test criterion is computed based only on the available pulses at that level. This results in a total of 4×8×8 positions tested (since the first pulse pairs are set to their track maxima).

Other two iterations are carried out by changing pulse assignment to tracks (replacing $k_0$ by $k_1$ for the second iteration and $k_0$ by $k_2$ for the third iteration). All 10 initial pulse positions are assigned to tracks $T_{(k_1+n)\ mod\ 5}$ in the second iteration and to tracks $T_{(k_2+n)\ mod\ 5}$ in the third iteration. The same search procedure described above is repeated for these other two iterations. For the three iterations, the total number of tested position combinations is 3×4×8×8=768.

In order to compute the codeword of the 35-bit fixed codebook, The two pulse positions in each track are encoded with 6 bits and the sign of the first pulse in each track is encoded with one bit. The second pulse sign is implicitly determined based on the order of pulse positions.

The two pulses in each track (2 positions and 2 signs) are encoded in 7 bits. Each pulse position needs 3 bits (8 possible positions) and each sign needs 1 bit. That is a total of 8 bits for each pair of pulses. However, 1 bit can be reduced considering the fact that about half the position combinations are redundant. For example, placing pulse 1 at position a and pulse 2 at position b is equivalent to placing pulse 1 at position b and pulse 2 at position a (when the signs are not considered). A simple approach of implementing the pulse encoding is to use only 1 bit for the sign information and 6 bits for the two positions, while ordering the positions in a way such that the other sign information can be easily deduced.

To better explain this, assume that the two pulses in a track are located at positions p1 and p2 with sign indices s1 and s2, respectively (s=0 if the sign is positive and s=1 if the sign is negative). The index of the two pulses is given by:

$$I=(p1/5)+s1\times 8+(p2/5)\times 16$$

If p1≦p2 then s2=s1; otherwise, s2 is different from s1. Thus, when constructing the codeword, if the two signs are equal, then the smaller position is assigned to p1 and the larger position to p2; otherwise, the larger position is assigned to p1 and the smaller position to p2. This procedure is repeated for each track to obtain five 7-bit indices.

The fixed codebook in backward LP mode differs from the forward mode. In the backward LP mode, the 18 bits needed for LP model are not transmitted. Thus, 9 bits are saved every sub-frame, which are used to increase the size of the fixed codebook from 35 to 44 bits. In this 44-bit codebook, each codebook vector contains 12 pulses. The positions in a sub-frame are divided into the same track structure described in Table E.2. However, two more pulses are placed, such that two consecutive tracks can contain three pulses instead of two. The two consecutive tracks containing three pulses will be called triple-pulse tracks and the other three tracks containing two pulses will be called double-pulse tracks.

The pulses in each double-pulse track are encoded with 7 bits (as in the 35-bit codebook) and those in each triple-pulse track are encoded with 10 bits. The index of the first triple-pulse track can have 5 different values (5 tracks). This index needs extra 3 bits. This results in a total of 44 bits (3×7+2×10+3).

The search procedure of the 44-bit codebook, is similar to that of the 35-bit codebook, with the exception that the tree has now 6 levels of pulse pairs. The same search procedure described above is followed.

The same procedure is used for pre-setting the pulse signs.

The initial tracks $T_k$ an d $T_{k+1}$ are determined in the same manner.

The 12 pulses $i_n$, n=0, . . . , 11 are assigned to tracks $T_{(k+n)\ mod\ 5}$, n=0, . . . , 11 respectively.

The pulses are searched in subsets of two pulses, by initially setting pulse $i_0$ to the maximum of track $T_k$ and pulse $i_1$ to the maximum of track $T_{(k+1)\ mod\ 5}$. Then it is proceeded by searching the pulse pair ($i_2$, $i_3$) by testing all the 8×8 possible position combinations in tracks $T_{(k+2)\ mod\ 5}$ and $T_{(k+3)\ mod\ 5}$ and repeating the procedure for the rest of the pulse pairs ($i_4$, $i_5$), ($i_6$, $i_7$), ($i_8$, $i_9$), and ($i_{10}$, $i_{11}$). This results now in a total of 5×8×8 positions tested.

Two more iterations are carried out similar to the 35-bit codebook resulting in a total of 3×5×8×8=960 tested positions.

Similar to G.729 and to the 35-bit forward codebook, the selected codebook vector is filtered through the pre-filter $P(z)=1/(1-\beta z^{-1})$ to enhance the harmonic components.

In computation of the codeword of the 44-bit fixed codebook, the two pulses in each of the three double-pulse tracks are encoded using the same approach described above.

The three pulses in a triple-pulse track are encoded using the same philosophy by adding three bits for the position of the third pulse. The three positions are encoded with 3 bits each and the sign of the first pulse is encoded with 1 bit. The signs of the other two pulses are deduced from the pulse orders, similar to the double-pulse tracks. Again, we will explain this with an example. Assume that the three pulses in a triple-pulse track are located at positions p1, p2, and p3 with sign indices s1, s2, and s3, respectively. The index of the three pulses is given by:

$$I=(p1/5)+s1\times 8+(p2/5)\times 16+(p3/5)\times 128$$

If p1≦p2 then s2=s1; otherwise, s2 is different from s1. Similarly, if p2≦p3 then s3=s2; otherwise, s3 is different from s2. When constructing the codeword, the pulse positions in a track are assigned to p1, p2, and p3 taking this sign relationship into consideration.

In total, 5 indices are returned, one for each track. The first index is that of the first triple-pulse track. This index is encoded with 13 bits; 10 for the positions and signs, as explained above, and 3 for the track index (0 to 4). The second index is that of the second triple-pulse track and is encoded with 10 bits. The last three indices are those of the three double-pulse tracks and are encoded with 7 bits each.

The encoder, FIG. 1, then performs the quantization of the gains in accordance with G.729 and performs a memory update.

The decoder, FIG. 1, functions to decode the signal. First the parameters are decoded. The transmitted parameters are listed in FIGS. 6 and 7. FIG. 6 illustrates the transmitted parameters indices in forward mode and FIG. 7 illustrates the transmitted parameters indices in backward mode. The first parameter decoded is the LP mode information and its parity bit. According to this information, the frame is classified either as forward, backward or erased. In forward mode, the decoder parameters are the LSP coefficients, the two fractional pitch delays, the two forward fixed-codebook vectors, and the two sets of adaptive- and fixed-codebook gains. In backward mode, the decoded parameters are the two fractional pitch delays, the two backward fixed-codebook vectors, and the two sets of adaptive- and fixed-codebook gains. Then, the LP backward analysis is performed on the past synthesized signal and the decoded parameters are used to compute the reconstructed speech signal as will be described below. This reconstructed signal is enhanced by a post-processing operation consisting of a postfilter, a high-pass filter and an upscaling (see E.4.2). Subclause E.4.4 describes the error concealment procedure used when either a parity error has occurred, or when the frame erasure flag has been set.

The parameter decoding procedure is similar to G.729. The number of parameters is greater (more excitation codebooks parameters and one LP mode indication parameter). The decoding process is done in the following order.

First, backward/forward decoding procedure is performed. One bit is used to indicate to the decoder the LP mode: backward or forward. Then, the parity bit mode is compared with this LP mode bit. If these bits are not identical, the frame is considered as erased and the procedure described below is applied. Otherwise, according to this LP mode indication, the same switching procedure as described above is performed at the decoder to obtain the LP filter that will be used for the synthesis.

Next the high stationarity indicator High_Stat(n) is computed once per frame as described above.

Then another high stationarity indicator High_Stat2 that will be used by the gain attenuation procedure in case of erased frame is computed each sub-frame (see E.4.4.3). If the current sub-frame is at least the 30th of consecutive backward subframes, High_Stat2 is set to 1, else it is set to zero.

Next the LP parameters are decoded. In any LP mode (backward or forward) and even if the frame is erased , one backward LP analysis per frame is performed, using the same procedures as those performed in the encoder above to obtain the encoder LP backward filter (windowing and autocorrelation computation, Levinson Durbin algorithm).

In forward mode, the same decoding procedure of the LP parameters is applied as in G.729. The interpolation procedure of the LP coefficients is the same as described above.

In case that one of the previous frames has been erased, the current backward filter computed $A_{bwd}^{(current)}$ is not directly used but linearly interpolated with the last "correct" backward filter prior to the interpolation procedure of the LP coefficients.

Before the excitation is reconstructed, the parity bit is recomputed from the adaptive-codebook delay index P1. If this bit is not identical to the transmitted parity bit P0, it is likely that bit errors occurred during transmission. If a parity error occurs on P1, the delay value $T_1$ is replaced by the delay value calculated in the previous sub-frame.

The adaptive-codebook vector is decoded the same as G.729. However, the fixed-codebook vector is decoded using the codebook indices. The received codebook indices are used to extract the positions and signs of the pulses. This is done by reversing the process described above for the 35-bit and/or 44-bit codebooks, respectively. Once the pulse positions and signs are decoded, the fixed codebook vector c(n) is constructed by:

$$c(n) = \sum_{i=0}^{N_p-1} s_i \delta(n - p_i)$$

where $s_1$ are pulse signs, $p_1$ are the pulse positions, and $N_p$ is the number of pulses (10 or 12). If the integer part of the pitch delay is less than the sub-frame size 40, c(n) is modified similar to equation (48) in G.729.

The adaptive- and fixed-codebook gains are decoded as described above, the same as G.729. The reconstructed speech is also computed in the same manner. However, the order of the LP filter could be 30 instead of 10.

As in G.729. The post-processing consists of three functions: adaptive postfiltering, high-pass filtering and signal upscaling. The adaptive postfiltering is similar to G.729 postfiltering except for the parameters $\gamma_p$, $\gamma_n$ and $\gamma_d$ that have been made adaptive according to the high stationarity indicator High_Stat and the current frame LP mode. After twenty consecutive high stationarity backward frames, there is no more postfiltering. The tilt compensation filtering is the same as G.729, except for the computation of the first parcor where the length of the impulse response is thirty two instead of twenty. Adaptive gain control and high-pass filtering and up-scaling are also the same as G.729.

SUMMARY OF THE INVENTION

A problem can occur in the implementation of G.729 Annex E when performing the search procedure for the fixed codebook search. The fixed codebook is searched by minimizing the mean square error between the weighted input speech and the weighted reconstructed speech, which is equivalent to maximizing the criterion $T_k$ which is stored in memory allocated by software of a size set by software fixed point implementation. The software sets an overflow bit to indicate when the value of $T_k$ overflows the memory because the value does not fit the space allocated.

In certain situations where the mean square error is substantial, the size of the value of the criterion $T_k$ may not fit into the memory allocated for storage of $T_k$. If the value is too large for the memory space, the memory will indicate a value of negative 1 (or another indication of overflow) due to the overflow condition. Because negative 1 is less than the other numbers in the register which are all positive, the negative 1 value will appear to be the minimum mean square error value. However, negative 1 is not a valid value, nor does the negative 1 correspond to the actual set of samples which provides the maximum $T_k$ nor the minimum mean square error difference. Therefore the fixed codebook search will not yield any valid results. The system will not know which set of samples to utilize.

Therefore, for certain inputs, such a residence of acoustic echoes, the G.729 Annex E codec crashes. The codec crash occurs because the criterion $T_k$ of the fixed codebook search fails to select a valid pulse position and leads to an uninitialized pulse position of the vector called "codvec" in function ACELP_12i40_44 bits and ACELP_10i40_35 bits. This causes an unbounded input to the function "build_code" that is called within the search algorithm and causes a crash in the system.

Since codvec represents a pulse position in each sub-frame and each sub-frame has a size of forty samples, the values of codvec should be from 0 to 39. In the G.729 Annex E specifications, the vector is uninitialized which allows for the unbounded condition to occur. The present invention teaches several ways to initialize the codvec vector to eliminate unbounded error while maintaining acceptable signal reproduction and robust performance.

There are 10 and 12 pulses in ACELP_12i40_44 bits and ACELP_10i40_35 bits respectively. In order to minimize the changes to the ITU source code and to ensure that the revised codec passes all the G.729Annex E test vectors, the following solutions are taught by the present invention:

Solution one, initialize the codvec with vector {1, 4, 7, 11, 15, 19, 23, 27, 31, 35, 37, 39} for both functions.

Solution two, initialize the codvec with vector {0, 3, 7, 11, 15, 19, 22, 25, 28, 31, 34, 38} in function ACELP_12i40_44 bits and {1, 5, 9, 13, 17, 21, 25, 29, 33, 37} in function ACELP_10i40 _35 bits.

Solution three, initialize codvec with random number sequences whose values are between 0 and 39.

Each of these solutions will provide bounded value for the codvec and allow signal processing under G.729 Annex E without code crash. The initialized values are only necessary and only used when the codebook search does not yield usable results for the minimum mean square error fixed codebook search.

Since the problem occurs with communications conforming to ITU G.729 Annex E, the solution to the problem must improve upon the Recommendation without departing from its requirements.

DESCRIPTION OF THE DRAWINGS

Preferred embodiments of the invention are discussed hereinafter in reference to the drawings, in which:

FIG. 4 illustrates the structure of the codec and code vectors.

FIG. 5 illustrates the fixed codebook tracks.

FIG. 6 illustrates the transmitted parameters indices in forward mode.

FIG. 7 illustrates the transmitted parameters indices in backward mode.

DETAILED DESCRIPTION OF THE INVENTION

A 5 ms portion of a signal, divided into 40 samples is received by the residual filter. In order to perform the codebook search, samples corresponding to the positions of the track in the codebook are extracted. The samples are processed by the same algorithm used by the decoder to reconstruct the signal. The algorithm is used to reconstruct the forty samples of the 5 ms portion of the signal. The reconstructed samples are compared to the weighted input forty samples and the criterion $T_k$ which is simplified difference between the weighted input and the weighted reconstructed set is determined and stored in a register. This process is repeated for each sample set of each track of the codebook.

Once all of the sample sets of the tracks of the codebook have been processed and the differences corresponding to each sample set of each track has been recorded, the values in the register are evaluated to determine the sample set which produced the maximum $T_k$, ie. the minimum mean square error. The vectors of the codvec are then set to correspond to the sample positions of the sample set yielding the minimum mean square error. The signal is processed according to the codvec vectors and packaged and transmitted for decoding.

The memory space allocated to store the values of $T_k$ has a fixed size (32 bits) and a fixed space to store each value. The register size can accommodate values up to 7FFF FFFF storage of values above 7FFF FFFF return a negative value. The codebook search can only accommodate positive values up to a certain value because the overflow bit has been set so that values of $T_k$ which exceed the maximum storable value will result in an overflow indication instead of storage of a truncated number which would lead to inaccuracies. The presence of a negative value in the register will not allow the codebook search to complete. Without completion, the value for the vectors for the codvec will be unbounded, as these vector values come from the result of the codebook search.

Figure 1:
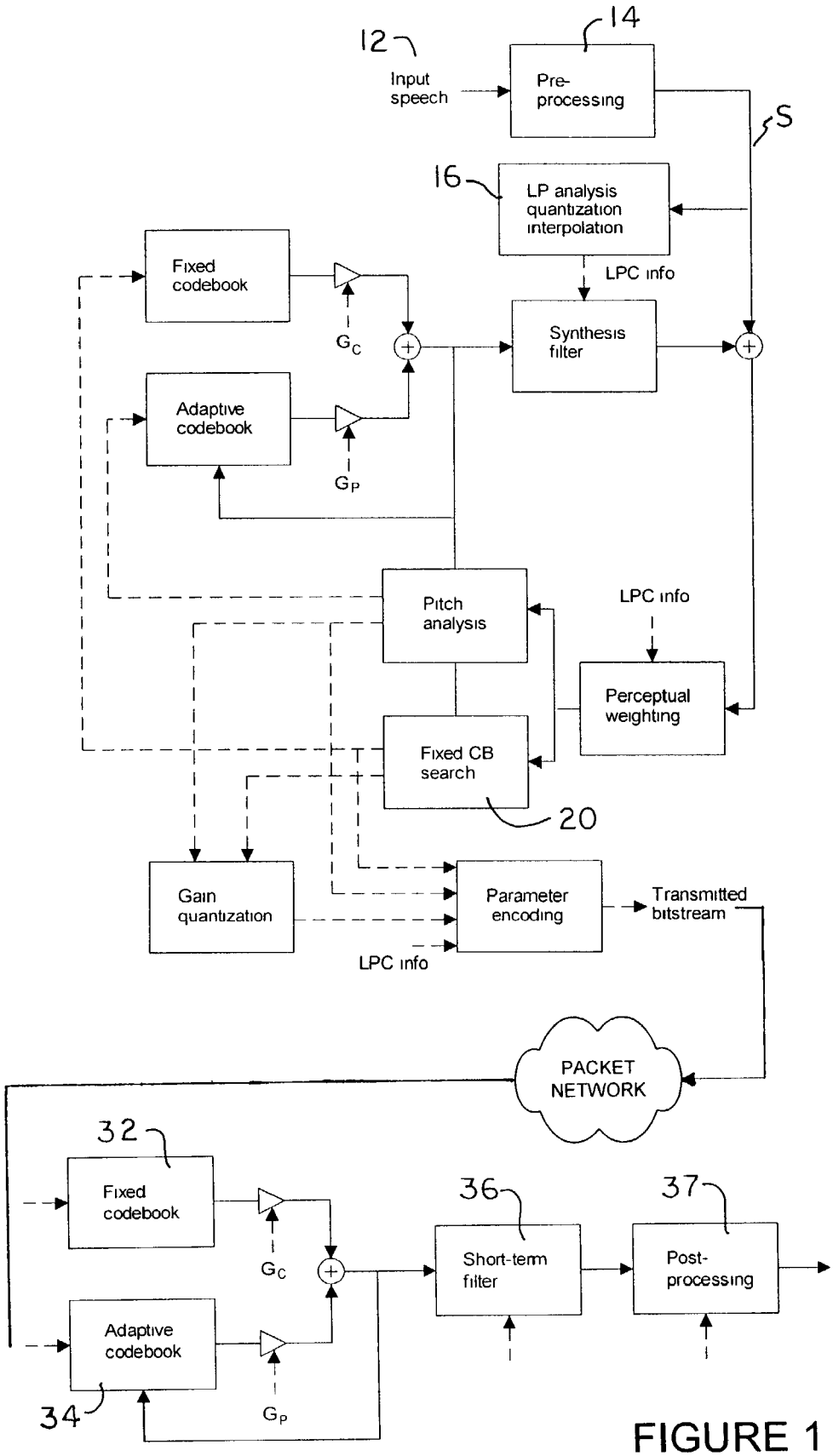
FIG. 1 is a block diagram illustrating the process steps for encoding and decoding an audio signal using the G.729 Annex E standards.
Figure 2:
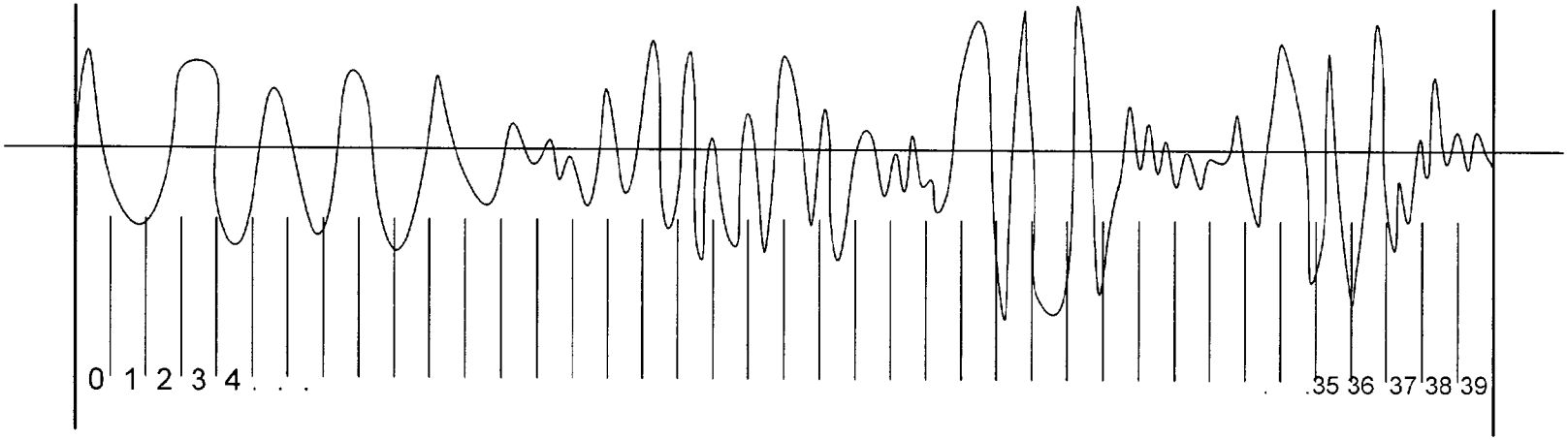
FIG. 2 illustrates a 5 ms portion of a signal divided into 40 samples.
Figure 3:
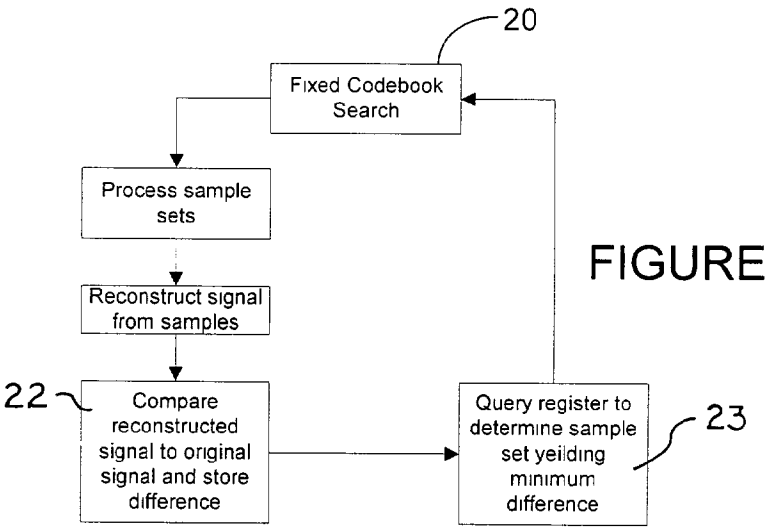
FIG. 3 is a simplified block diagram illustrating the steps of the fixed codebook search.

The present invention provides for the initialization of the codvec vectors to allow for getting valid fixed codebook codewords when the codebook search is unable to identify the minimum mean square error. The Codvec is a set of values which represent pulse positions in each sub-frame from which the entire set of forty values in the sub-frame are reconstructed in the decoder. Each sub-frame of 5 ms has a size of forty samples, the values of the positions of the samples which make up the codvec should therefore be from 0 to 39, as illustrated in FIG. 2.

The codvec will have vector values determined by the sample set yielding the minimum mean square error as determined by the codebook search, unless the register experiences overflow. In the G.729 Annex E specifications, the vector codvec is uninitialized which allows for the unbounded condition to occur when the memory register $T_k$ experiences overflow. The present invention teaches that initialization of the codvec will eliminate an unbounded condition when overflow occurs. Because the codvec cannot be updated, the present invention provides a default set of values for the codvec to prevent an unbounded condition. There are several ways to initialize the codvec vector to eliminate unbounded error while maintaining acceptable signal reproduction and robust performance taught by the present invention.

There are 10 and 12 pulses in ACELP_12i40_44bits and ACELP_10i40_35 bits respectively. In order to minimize the changes to the ITU source code and to ensure that the revised codec passes all the G.729Annex E test vectors, the following solutions are taught by the present invention:

Solution one initializes the codvec with vector {1, 4, 7, 11, 15, 19, 23, 27, 31, 35, 37, 39} for both functions. This method approximates an even spread of the pulse sample for both ten and twelve pulse sets. For twelve pulses, all of the vectors are used. For ten pulses only vectors 1 through 35 are used. Because the final two pulses are separated by only two place from their immediately preceding pulses, a maximum spread coverage can be obtained even for both ten and twelve pulse sets. The slight compression at both ends of the set does not adversely affect the performance of the codvec vector upon reconstruction of the signal. This solution is implemented with the least utilization of processing resources. Only a single vector set must be maintained and/or generated and only a single initialization need be implemented.

Solution two initializes the codvec with vector {0, 3, 7, 11, 15, 19, 22, 25, 28, 31, 34, 38} in function ACELP_

12i40_44bits and {1, 5, 9, 13, 17, 21, 25, 29, 33, 37} in function ACELP_10i40_35 bits. By using a separate vector sets for each function, the smoothest spread of the default vector set can be achieved. The vectors are more evenly distributed for both ten and twelve vector sets. This solution is more complex, requiring the maintenance and/or generation of two vector sets and requiring a determination of the implementation function (ten or twelve pulses) so that the appropriate vector set can be used.

Solution three initializes codvec with random number sequences whose values are between 0 and 39. This solution can also be implemented with minimal resource burden and will avoid the code search crash which occurs when the minimum search vectors cannot be determined. The random assignment of vectors will not necessarily result in an even spread of vectors but will generally yield acceptable results which may not minimize the difference between the original signal and the reconstructed signal but will allow continued signal processing until a minimization vector set can be determined.

Each of these solutions will provide bounded value for the codvec and allow signal processing under G.729 Annex E without code crash. The initialized values are only necessary and only used when the codebook search does not yield usable results for the minimum mean square error.

Because many varying and different embodiments may be made within the scope of the inventive concept herein taught, and because many modifications may be made in the embodiments herein detailed in accordance with the descriptive requirements of the law, it is to be understood that the details herein are interpreted as illustrative and not in a limiting sense.

What is claimed is:

1. A method of providing a fixed codebook vector value set for ITU Recommendation G.729 Annex E compliant signal encoding, comprising the steps of:

initializing a vector set for the fixed codebook based upon a generally even distribution of available samples;

performing a codebook search according to ITU Recommendation G.729 Annex E; and updating said initialized vector set when said codebook search yields a vector set having a minimum mean square error value, and maintaining said initialized vector set when said codebook search does not yield a minimum mean square error value.

2. The method of claim 1, further including the step of:

using said initialized vector set to encode said signal when said codebook search does not yield a minimum mean square error value.

3. The method of claim 2, further including the step of:

using said updated vector set to encode said signal when said codebook search yields a minimum mean square error value.

4. The method of claim 1, wherein:

said initialized vector set is a single set of vectors for forward and backward encoding.

5. The method of claim 4, wherein:

said initialized vector set is {1, 4, 7, 11, 15, 19, 23, 27, 31, 35, 37, 39}.

6. The method of claim 5, wherein:

each of said vectors of said initialized set are used for twelve pulse vector encoding.

7. The method of claim 5, wherein:

the first ten of said vectors of said initialized set are used for ten pulse vector encoding.

8. The method of claim 1, wherein:

said initialized vector set includes two vector sets, one for forward encoding and a separate vector set for backward encoding.

9. The method of claim 8, wherein:

said initialized vector sets are {0, 3, 7, 11, 15, 19, 22, 25, 28, 31, 34, 38}{1, 5, 9, 13, 17, 21, 25, 29, 33, 37}.

10. The method of claim 8, wherein:

said vector set of {0, 3, 7, 11, 15, 19, 22, 25, 28, 31, 34, 38} is used for twelve pulse forward vector encoding.

11. The method of claim 8, wherein:

said vector set of {1, 5, 9, 13, 17, 21, 25, 29, 33, 37} are used for ten pulse vector encoding.

12. The method of claim 1, wherein:

said initialized set of vectors is a random number sequences whose values are between 0 and 39.

* * * * *